US006513463B2

(12) United States Patent
Katayama

(10) Patent No.: US 6,513,463 B2
(45) Date of Patent: Feb. 4, 2003

(54) COOLING SYSTEM FOR OUTBOARD MOTOR

(75) Inventor: Goichi Katayama, Shizuoka (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 3 days.

(21) Appl. No.: 09/810,742

(22) Filed: Mar. 16, 2001

(65) Prior Publication Data

US 2001/0027757 A1 Oct. 11, 2001

(30) Foreign Application Priority Data

Mar. 16, 2000 (JP) ..... 2000-074225

(51) Int. Cl.[7] ..... F01P 3/12; B63H 21/10
(52) U.S. Cl. ..... 123/41.29; 440/88
(58) Field of Search ..... 123/41.29, 41.31, 123/41.33, 540, 456; 440/88

(56) References Cited

U.S. PATENT DOCUMENTS 5,438,962 A 8/1995 Iwata et al.
5,823,835 A 10/1998 Takahashi et al.
5,921,829 A 7/1999 Iwata
5,975,032 A 11/1999 Iwata
5,980,340 A 11/1999 Okamoto
5,984,743 A * 11/1999 Wada et al. ..... 440/88
6,184,599 B1 2/2001 Okabe et al.

FOREIGN PATENT DOCUMENTS

JP 6-42345 2/1994
JP 11-324696 11/1999

* cited by examiner

*Primary Examiner*—Gene Mancene
*Assistant Examiner*—Arnold Castro
(74) *Attorney, Agent, or Firm*—Knobbe, Martens Olson & Bear LLP

(57) ABSTRACT

An engine for an outboard motor includes engine components disposed around the engine body. A cooling system includes a first water passage cooling the engine body and a second water passage branching off from the first water passage upstream the engine body and extending through the engine components. One engine component is generally positioned above the engine body. Two engine components are positioned on different sides of the engine body. The first and second water passages have separate discharge ports. The engine components are made of a metal material. The second water passage is defined by tubular members made of a corrosion-resistant material and the respective tubular members are embedded in the respective bodies of the engine components.

33 Claims, 10 Drawing Sheets

COOLING SYSTEM FOR OUTBOARD MOTOR

PRIORITY INFORMATION

This application is based on and claims priority to Japanese Patent Application No. 2000-074225, filed Mar. 16, 2000, the entire contents of which is hereby expressly incorporated by reference.

BACKGROUND OF THE INVENTION

1. Field of the Invention

This invention relates to a cooling system for an outboard motor. More particularly, the present invention relates to a cooling system for an engine and a plurality of engine components of an outboard motor.

2. Description of Related Art

Typically, an outboard motor comprises an engine disposed atop a drive unit of the motor. To propel the associated watercraft, the engine drives a propulsion device placed in a submerged position through a proper drive mechanism. The engine usually has an engine body and a plurality of components. The engine body normally comprises a cylinder block, a cylinder head assembly and a crankcase assembly. At least one combustion chamber, and often more than one combustion chamber, is provided within the engine. Occasionally, part of an exhaust passage is unitarily formed with the engine body. Other engine components can include, for example, air intake conduits, fuel supply conduits, lubricant delivery conduits and a power generator, which all relate to the operation of the engine.

The engine body comprising the exhaust part and the foregoing engine components usually build much heat during the engine operations. The heat can accumulate therein unless properly removed and excessive heat can jeopardize normal engine operations. Typical engines thus have a cooling system that can cool the heated portions of the engine body and engine components. Various cooling systems are practicable.

One type of cooling system introduces water from outside of the motor and cools the engine body first because the engine body is subjected to greater temperature levels when compared to peripheral engine components. The water that has cooled the engine body then flows to the respective peripheral engine components. Another type of cooling system has a direct conduit branching off upstream of the engine body to supply fresh water to a peripheral engine component.

For instance, U.S. Pat. Nos. 5,975,032 and 5,980,340 disclose the former type of cooling system, while U.S. Pat. No. 5,438,962 discloses the latter type of cooling system. Japanese Laid-Open Patent Publication No. Hei 6-42345, published on Feb. 15, 1994, also discloses a rectifier-regulator cooling structure using fuel or water flowing through a cooling passage. Furthermore, Japanese Laid-Open Patent Publication No. Hei 11-324696, published on Nov. 26, 1999, discloses a cooling system that can cool a power generator and a high pressure fuel pump. An auxiliary water supply passage branches off from a main water supply passage to the generator and then to the fuel pump. The water that has cooled these two components then is discharged through a submerged discharge port.

In engine design for outboard motors, there is an increasing emphasis on obtaining high performance in output and more effective emission control. This trend has resulted in employing, for example, a multi-cylinder, fuel injected, four-cycle engine. This type of engine must have a greater number of engine components or larger sizes thereof than those of conventional engines. The engine body and the engine components of this new type of engine also produce greater heat levels than two-stroke engines. Particularly, if the components are one-sided or if the components are disposed such that only one side is cooled, the engine can develop disadvantageous hot zones. The hot zones can result in distortion of the engine body or engine components, or disruption of proper engine operations. The forgoing conventional cooling systems are not enough to resolve this problem.

A need therefore exists for an improved cooling system for an outboard motor that can cool an engine body and engine components efficiently and that can maintain a relatively good heat balance in connection with the respective sides.

In addition, if a cooling system malfunctions such that water can no longer be supplied to the portions that need the water for cooling, the engine can overheat. Engine overheat can result in, for example, seizure of pistons and malfunction of engine components. A pilot water discharge is useful to let the operator know of cooling system abnormalities, such as plugging. U.S. Pat. No. 5,823,835 discloses such a pilot water discharge. In this arrangement, a pilot discharge port is positioned above the water line and a small amount of cooling water that has passed through cooling jackets disposed in the engine body is expelled through this pilot discharge port as visual confirmation to the operator that cooling water is being properly supplied to the engine body.

As noted above, the engine body produces heat greater than the engine components, and in addition, the heat of the recent multiple cylinder engine is higher than before. The elevated temperature of the pilot water can discolor the coating that covers a surface of the housing or cowling of the outboard motor. For instance, in the region of the port, the high temperature water can discolor the outward appearance of the motor or cause scaling and the like.

Another need thus exists for an improved cooling system that has a pilot water discharge that does not adversely affect to a large degree the outward appearance of the outboard motor.

Further, the foregoing engine components are generally formed with metal material, such as, for example, aluminum based alloy cast material as well as the engine body. Otherwise, at least part of the engine components is formed with metal material for the heat exchange purpose although the rest part of the components is made of other material such as plastic. When the motor is used on the sea, seawater, i.e., salt water, is supplied to the engine components. The salt water, however, is likely to corrode bodies of the engine components that are made of metal material and hence can damage their primary functions.

A further need therefore exists for an improved cooling system for an outboard motor that can inhibit corrosion from encroaching engine components.

SUMMARY OF THE INVENTION

Accordingly, one aspect of the present invention involves an internal combustion engine for an outboard motor comprising an engine body, at least three engine components disposed around the engine body, and a water cooling system for cooling both the engine body and the engine components. The cooling system comprises a first water passage arranged to cool the engine body and a second water passage branching off from the first water passage upstream of the engine body and extending through the at least three engine components. A first of the at least three engine components is generally positioned above the engine body while a second and a third of the at least three engine components is generally positioned on a different side of the engine body relative to one another.

Another aspect of the present invention involves an internal combustion engine comprising an engine body, a plurality of engine components disposed around the engine body, and a water cooling system for cooling both the engine body and the engine components. The cooling system comprises a first water passage arranged to cool the engine body and a second water passage branching off from the first water passage upstream of the engine body and extending through the plurality of engine components in series. The first and second water passages have separate discharge ports that are located remotely from each another and the water discharge port of the second water passage is positioned next to the engine body.

A further aspect of the present invention involves an internal combustion engine comprising an engine body, a plurality of engine components being disposed around the engine body, and a water cooling system arranged to cool both the engine body and the plurality of engine components. The cooling system comprises a first water passage arranged to cool the engine body and a second water passage branching off from the first water passage upstream of the engine body and extending through the plurality of engine components. The plurality of engine components are made of a metal material with the second water passage in part being defined by tubular members made of a corrosion-resistant material. The respective tubular members are at least partially embedded in respective bodies of the engine components.

Another aspect of the present invention involves an internal combustion engine comprising an engine body, a plurality of engine components disposed around the engine body, and a cooling system for cooling both the engine body and the plurality of engine components. The cooling system comprises a first coolant passage arranged to cool the engine body and a second coolant passage branching off from the first coolant passage upstream of the engine body and extending through at least three of the plurality of engine components. The at least three engine components comprising a first engine component positioned at least above the engine body and a two engine components each positioned on two sides of the engine body so as to be spaced apart from each other.

An additional aspect of the present invention involves an outboard motor comprising an engine body, a plurality of engine components disposed around the engine body, and a water cooling system comprising a water inlet disposed lower than the engine body so as to introduce the water into the cooling system. A first water passage is arranged to cool the engine body and a second water passage is arranged to cool the plurality of engine components. The first water passage has a first water discharge port positioned closer to the water inlet than to the engine body and the second water passage has a second water discharge port positioned closer to the engine body than to the water inlet.

Further aspects, features and advantages of this invention will become apparent from the detailed description of the preferred embodiment which follows.

BRIEF DESCRIPTION OF THE DRAWINGS

These and other features, aspects and advantages of the present invention will now be described with reference to the drawings of a preferred embodiment which is intended to illustrate and not to limit the invention. The drawings comprise 14 figures.

DETAILED DESCRIPTION OF THE PREFERRED EMBODIMENTS OF THE INVENTION

Figure 1:
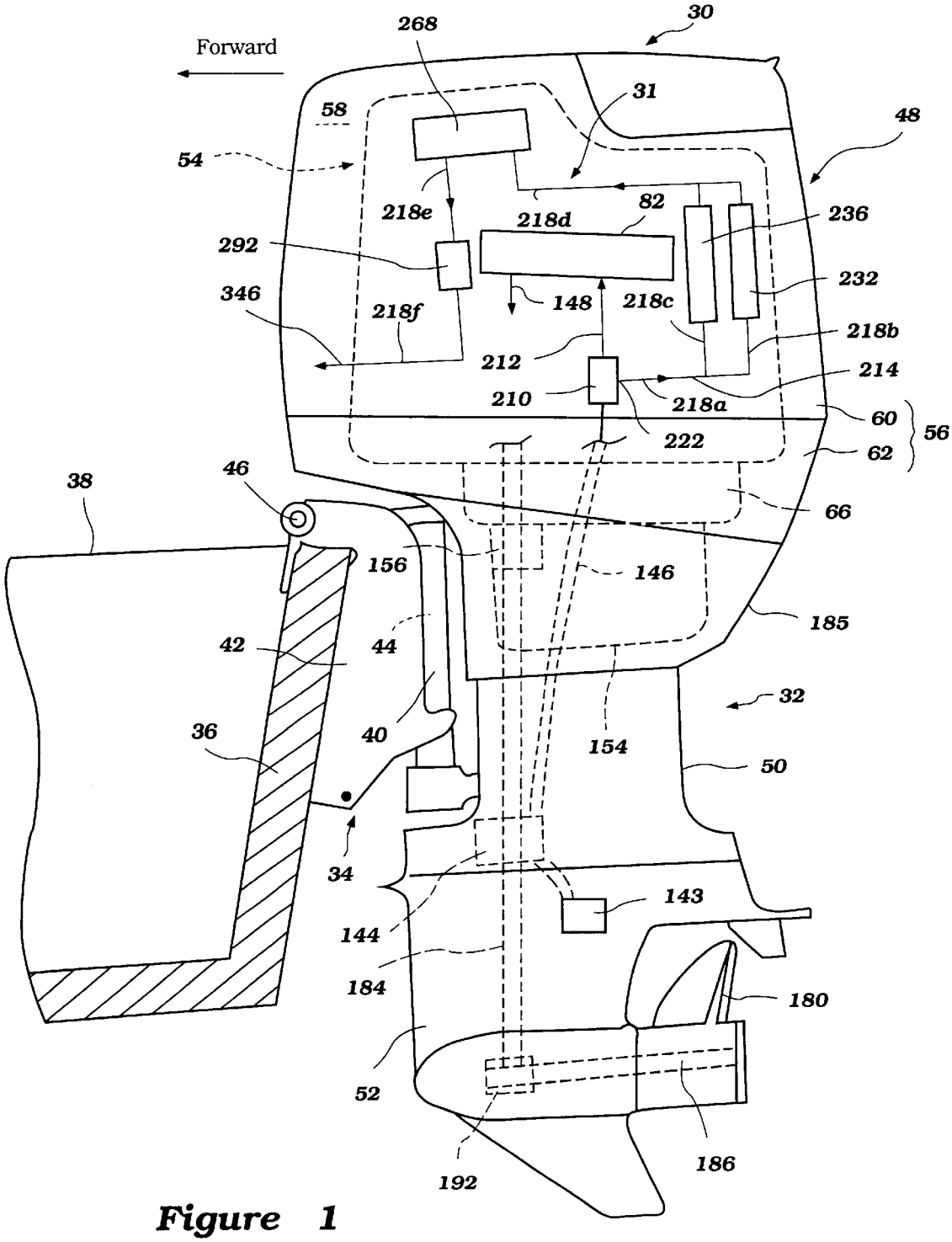
FIG. 1 is a side elevational view of an outboard motor comprising a cooling system arranged in accordance with a preferred embodiment of the present invention. The cooling system is illustrated schematically in the figure and actual positioning of respective engine components and a pilot discharge port can differ from those illustrated. A watercraft associated with the outboard motor also is partially shown in section.

With reference to FIGS. 1–4, an overall construction of an outboard motor 30, which employs a cooling system 31 arranged in accordance with certain features, aspects and advantages of the present invention will be described. In the illustrated arrangement, the outboard motor 30 comprises a drive unit 32 and a bracket assembly 34. The bracket assembly 34 supports the drive unit 32 on a transom 36 of an associated watercraft 38 and places a marine propulsion device in a submerged position with the watercraft 38 resting on the surface of a body of water. The bracket assembly 34 preferably comprises a swivel bracket 40, a clamping bracket 42, a steering shaft 44 and a pivot pin 46.

The steering shaft 44 typically extends through the swivel bracket 40 and is affixed to the drive unit 32. The steering shaft 44 is pivotally journaled for steering movement about a generally vertically-extending steering axis defined within the swivel bracket 40. The clamping bracket 42 comprises a pair of bracket arms that are spaced apart from each other and that are affixed to the watercraft transom 36. The pivot pin 46 completes a hinge coupling between the swivel bracket 40 and the clamping bracket 42. The pivot pin 46 extends through the bracket arms so that the clamping bracket 42 supports the swivel bracket 40 for pivotal movement about a generally horizontally-extending tilt axis defined by the pivot pin 46. The drive unit 32 thus can be tilted or trimmed about the pivot pin 46.

As used through this description, the terms "forward," "forwardly" and "front" mean at or to the side where the bracket assembly 34 is located, and the terms "rear," "reverse," "backwardly" and "rearwardly" mean at or to the opposite side of the front side, unless indicated otherwise or otherwise readily apparent from the context use.

A hydraulic tilt and trim adjustment system preferablyis provided between the swivel bracket 40 and the clamping bracket 42 to tilt (raide or lower) the weivel bracket 40 and the drive unit 32 relative to the clamping bracket 42. Otherwise, the outboard motor 30 can have a manually operated system for tilting the drive unit 32. Typically, the term "tile movement", when used in a broad sense, comprises both a tilt movement and a trim adjustment movement.

The illustrated drive unit 32 comprises a power head 48, a driveshaft housing 50 and a lower unit 52. The power head 48 is disposed atop the drive unit 32 and comprises an internal combustion engine 54 that is positioned within a protective cowling 56. Preferably, the protective cowling 56 defines a generally closed cavity 58 in which the engine 54 is disposed. The protective cowling 56 preferably comprises a top cowling member 60 and a bottom cowling member 62. The top cowling member 60 is preferably detachably affixed to the bottom cowling 62 by a coupling mechanism 63 (see FIGS. 3 and 4) so that a user, operator, mechanic or repair person can access the engine 54 for maintenance or for other purposes.

Figure 3:
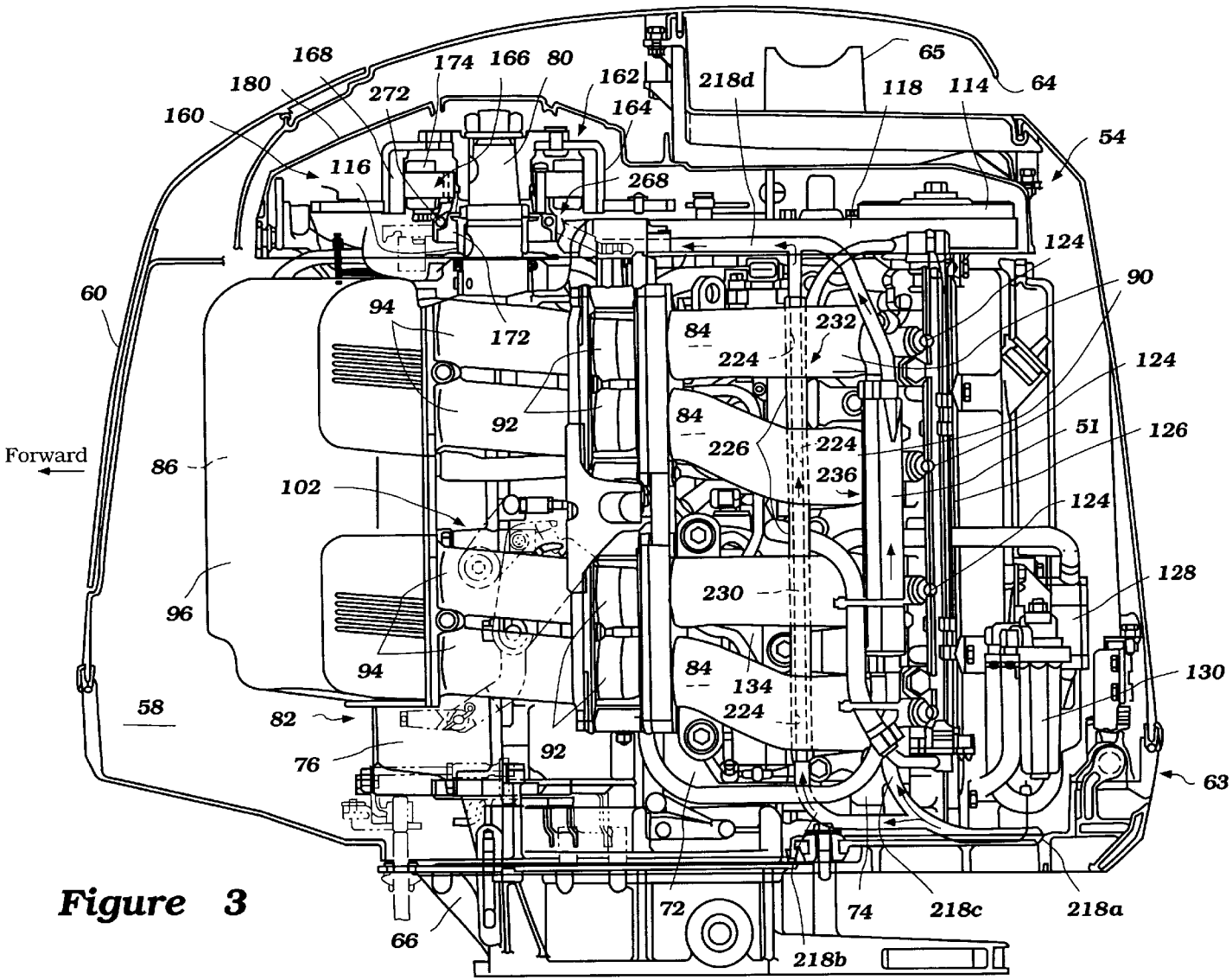
FIG. 3 is an enlarged port side view of the engine with a portion of the power head illustrated in section and with a portion of the engine being shown in section.
Figure 4:
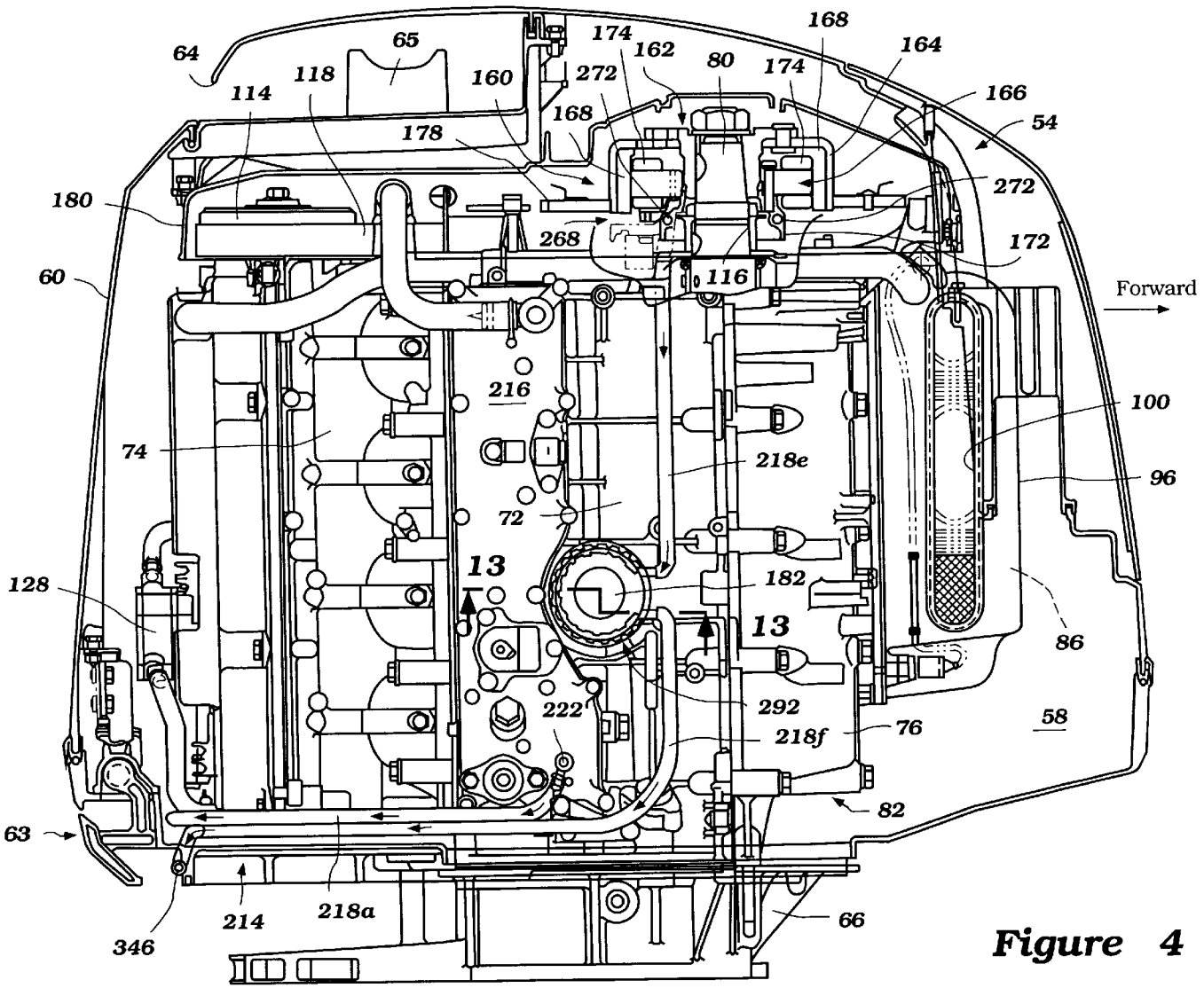
FIG. 4 is another enlarged starboard side view of the engine with a portion of the power head illustrated in section and with a portion of the engine being shown in section.

With continued reference to FIGS. 3 and 4, the top cowling 60 preferably has at least one air intake opening 64 and at least one air duct 65 disposed on its rear and top portion. Ambient air is drawn into the closed cavity 58 from within the opening 64 through the duct 65. Typically, the top cowling member 60 tapers in girth toward its top surface, which is in the general proximity of the air intake opening 64.

With reference again to FIG. 1, the bottom cowling member 62 preferably has an opening at its bottom portion through which an upper portion of an exhaust guide member 66 extends. The exhaust guide member 66 is affixed atop the driveshaft housing 50. The bottom cowling member 62 and the exhaust guide member 66 together generally form a tray. The engine 54 is placed onto this tray and is affixed to the exhaust guide member 66. The exhaust guide member 66 also has an exhaust passage through which burnt charges (e.g., exhaust gases) from the engine 54 are discharged as described below.

The engine 54 in the illustrated embodiment operates on a four-cycle combustion principle. With reference now to FIG. 2, the engine 54 has a cylinder block 72. The presently preferred cylinder block 72 defines four cylinder bores 73 which extend generally horizontally and are generally vertically spaced from one another. As used in this description, the term "horizontally" means that the subject portions, members or components extend generally in parallel to the water line where the associated watercraft is resting when the drive unit 32 is not tilted and is placed in the position shown in FIG. 1. The term "vertically" in turn means that portions, members or components extend generally normal to those that extend horizontally. This type of engine, however, merely exemplifies one type of engine on which various aspects and features of the present invention can be suitably used. Engines having other number of cylinders, having other cylinder arrangements, and operating on other combustion principles (e.g., crankcase compression two-stroke or rotary) also can employ various features, aspects and advantages of the present invention.

A piston (not shown) reciprocates in each cylinder bore 73 in a well-known manner. A cylinder head assembly 74, such as that illustrated in FIG. 2, for instance, is affixed to one end of the cylinder block 72 for closing the cylinder bores 73. The cylinder head assembly 74 preferably defines four combustion chambers together with the associated pistons and cylinder bores 73. Of course, the number of combustion chambers can vary, as indicated above. A crankcase assembly 76 closes the other end of the cylinder bores 73 and defines a crankcase chamber together with the cylinder block 72. A crankshaft 80 extends generally vertically through the crankcase chamber and is journaled for rotation by several bearing blocks (not shown) in a suitable arrangement. Connecting rods (not shown) couple the crankshaft 80 in a well-known manner with the respective pistons. Thus, the crankshaft 80 can be rotated by the reciprocal movement of the pistons.

Preferably, the crankcase assembly 76 is located at the most forward position, with the cylinder block 72 and the cylinder head member 74 extending rearward from the crankcase assembly 76, one after another. Generally, the cylinder block 72, the cylinder head member 74 and the crankcase assembly 76 together define an engine body 82. Preferably, at least these major engine portions 72, 74, 76 are made of aluminum based alloy. The aluminum alloy advantageously increases strength over cast iron while decreasing the weight of the engine body 72.

The engine 54 comprises an air induction system. The air induction system draws air to the combustion chambers from the cavity 58 of the protective cowling assembly 56. The air induction system preferably comprises intake ports, four intake passages 84 and a plenum chamber 86. The intake ports can be defined in the respective cylinder head members 74. In one configuration, intake valves repeatedly open and close the respective intake ports. When each intake port is opened, the corresponding intake passage 84 communicates with the associated combustion chamber.

In the illustrated arrangement, the air intake passages 84 are defined by a pair of intake manifolds 90, a set of throttle bodies 92 and a set of intake runners 94, while the plenum chamber 86 is defined by a plenum chamber member 96. The plenum chamber member 96 has an inlet port 100 opening to the closed cavity 58 to draw the air in the cavity 58 into the plenum chamber 86. Each intake manifold 90 has a flange portion that is affixed to the cylinder head member 74. The throttle bodies 92 are interposed between the intake manifolds 90 and the intake runners 94. The plenum chamber 86 defined by the plenum chamber member 96 is thus coupled with the associated intake ports through the intake passages 84 defined by the intake runners 94, the throttle bodies 92 and the intake manifolds 90.

The intake manifolds 90 and the throttle bodies 92 preferably are made of aluminum based alloy. The intake runners 94 preferably are unitarily formed with the plenum chamber member 96 and this unitary component preferably is made of a plastic or resin-based material. In some configurations, an aluminum based alloy can be used. In either case, i.e., aluminum based alloy or plastic material, the intake manifolds 90, the throttle bodies 92 and the combined intake runner and plenum chamber member can be produced by, for example, a conventional casting method. Of course, these intake components can be made of other materials and by other conventional manufacturing processes.

The respective throttle bodies 92 preferably have throttle valves journaled therein for pivotal movement about an axis of a valve shaft that extends generally vertically. While not shown, in the illustrated arrangement, the throttle valves advantageously are butterfly valves. The throttle valves are operable by the operator through an appropriate conventional throttle valve linkage 102 (see FIG. 3). The throttle valves measure or regulate an amount of air flowing through the respective air intake passages 84. In other words, the air amount is variable by changing the positions or opening degrees of the throttle valves. Normally, the greater the opening degree, the higher the rate of airflow and the higher the engine speed.

The engine 54 also comprises an exhaust system that discharges the burnt charges or exhaust gases to a location outside of the outboard motor 30. Each cylinder bore 73 preferably has exhaust ports defined in the cylinder head assembly 74. The exhaust ports are repeatedly opened and closed by exhaust valves.

An exhaust manifold 106 (see FIG. 2) is defined next to the cylinder bores 73 in the cylinder block 72 and preferably extends generally vertically. The exhaust manifold 106 communicates with the exhaust ports to collect exhaust gases from the combustion chambers through the respective exhaust ports. The exhaust manifolds 106 are coupled with the exhaust passage in the exhaust guide member 66. When the exhaust ports are opened, the combustion chambers communicate with this exhaust passage through the exhaust manifold 106.

A valve cam mechanism is preferably provided for actuating the intake and exhaust valves. In the illustrated embodiment, the cylinder head assembly 74 journals an intake camshaft 110 and an exhaust camshaft 112. The camshafts 110, 112 extend generally vertically and in parallel to each other. The intake camshaft 110 actuates the intake valves, while the exhaust camshaft 112 actuates the exhaust valves. The respective camshafts 110, 112 have cam lobes to push the intake and exhaust valves in a controlled timing to open and close the intake and exhaust ports. A single camshaft can replace the intake and exhaust camshafts 110, 112 in a manner that is well known. Other conventional valve drive mechanisms can be of course employed instead of such a mechanism using one or more camshafts.

A camshaft drive mechanism is provided for driving the valve cam mechanism. As seen in FIG. 2, intake and exhaust camshafts 110, 112 have driven sprockets 114 positioned atop thereof and the crankshaft 80 has a drive sprocket 116 positioned almost atop thereof. A timing chain or belt 118 is wound around the drive and driven sprockets 116, 114. The crankshaft 80 thus drives both the camshafts 110, 112 through the timing chain 118 in timed relationship. A tensioner 120 preferably abuts on a side of the timing chain 118 so as to give proper tension to the chain 118. A diameter of the driven sprockets 114 preferably is twice as large as a diameter of the drive sprocket 116. The intake and exhaust camshafts 110, 112 thus rotate at half of the speed of the rotation of the crankshaft 80.

The engine 54 preferably has a port or manifold fuel injection system. The fuel injection system preferably comprises four fuel injectors 124 with one fuel injector allotted for each of the respective combustion chambers. Each fuel injector 124 preferably has an injection nozzle directed toward the associated intake passage 84 adjacent to the intake ports. The fuel injector 124 also preferably has a plunger that normally closes the nozzle and solenoid coil that moves the plunger from the closed position to an open position when energized with electric power. Of course, in some arrangements, the fuel injectors can be disposed for direct cylinder injection and, in other arrangements, carburetors can replace or accompany the fuel injectors.

The fuel injectors 124 spray fuel into the intake passages 84 under control of an ECU (electronic control unit). The ECU controls energizing timing and duration of the solenoid coils so that the plungers open the nozzles to spray a proper amount of the fuel into the engine 54 during each combustion cycle. A fuel rail 126 supports the fuel injectors 124 and also defines a fuel passage to the injectors 124. The fuel rail 126 preferably extends generally vertically along a side surface of the cylinder head assembly 74 on the port side. The fuel rail 126 preferably is made of metal material such as, for example, an aluminum-based alloy, similar to the engine body 82.

The fuel injection system further comprises a fuel supply tank that preferably is placed in the hull of the associated watercraft 38. Fuel is drawn from the fuel tank by a first low pressure fuel pump (not shown) and a second low pressure pump 128 (see FIG. 3) through a fuel supply conduit. The first low pressure pump preferably is a manually operated pump. The second low pressure pump 128 preferably is a diaphragm-type pump that can be operated by, for example, the intake or exhaust camshaft 110, 112. In this instance, the second low pressure pump 128 is mounted on the cylinder head assembly 74. A quick disconnect coupling can be provided in the supply conduit. Also, a fuel filter 130 can be positioned in the supply conduit at an appropriate location. The fuel filter 130 is preferably mounted on the cylinder head assembly 74.

From the second low pressure pump 128, the fuel enters a vapor separator 134 from the fuel supply conduit. In the illustrated arrangement, the vapor separator 134 is disposed in a space defined between the port side surface of the engine body 82 and the intake manifolds 90 and the vapor separator is advantageously mounted on the cylinder block 72. At the vapor separator end of the supply conduit, a float valve can be provided that is operated by a float to maintain a substantially uniform level of the fuel within the vapor separator 134.

A high pressure fuel pump preferably is provided in the vapor separator 134. The high pressure fuel pump pressurizes fuel that is delivered through a delivery conduit to the fuel injectors 124 on the fuel rail 126. The high pressure fuel pump in the illustrated arrangement preferably comprises a positive displacement pump. The construction of the pump thus generally inhibits fuel flow from its upstream side back into the vapor separator 134 when the pump is not running. A back-flow prevention device (e.g., a check valve) also can be used to prevent a flow of fuel from the delivery conduit back into the vapor separator 134 when the pump is off. This later approach can be used with a fuel pump that employs a rotary impeller to inhibit a drop in pressure within the delivery conduit when the pump is intermittently stopped. An electric motor preferably drives the high pressure fuel pump. The electric motor is preferably unified with the high pressure pump at its bottom portion and hence is disposed in the vapor separator 134.

Excess fuel that is not injected by the injector 124 returns to the vapor separator 134 through a return conduit. A pressure regulator 138 preferably is positioned at the most upstream portion of the return conduit, i.e., atop the fuel rail 126. The pressure regulator 138 limits fuel pressure to keep it at a fairly constant level at all times.

A desired amount of the fuel is sprayed into the intake passages 84 through the injection nozzles at a selected timing for a selected duration. The timing and duration preferably are controlled by the ECU. Because the pressure regulator 138 controls and stabilizes the fuel pressure, the duration can be used to determine a selected amount of fuel that will be supplied to the combustion chambers. Various control strategies for the injection timing and injection duration can be applied so that the optimum engine operation or an operation near to the optimum operation will be realized.

The fuel injection system will be described further in connection with the cooling system 31 later.

The engine 54 further comprises an ignition or firing system. Each combustion chamber is provided with a spark plug connected to the ECU so that ignition timing is also controlled by the ECU. The spark plugs have electrodes that are exposed into the associated combustion chamber and that ignite an air/fuel charge in the combustion chamber at selected ignition timing. The ignition system preferably has an ignition coil and an igniter which are disposed between the spark plugs and the ECU. In order to enhance or maintain engine performance, the ignition timing can be advanced or delayed in response to various engine running conditions.

The ignition coil preferably is a combination of a primary coil element and a secondary coil element that are wound around a common core. Desirably, the secondary coil element is connected to the spark plugs, while the primary coil element is connected to the igniter. Also, the primary coil element is coupled with a power source so that electrical current flows therethrough. The igniter abruptly cuts off the current flow in response to an ignition timing control signal from the ECU and then a high voltage current flow occurs in the secondary coil element. The high voltage current flow forms a spark at each spark plug.

In the illustrated engine 54, the pistons reciprocate between top dead center and bottom dead center. When the crankshaft 80 makes two rotations, the pistons generally move from top dead center to bottom dead center (the intake stroke), from bottom dead center to top dead center (the compression stroke), from top dead center to bottom dead center (the power stroke) and from bottom dead center to top dead center (the exhaust stroke). During the four strokes of the pistons, the respective camshafts 110, 112 make one rotation. The intake camshaft 110 actuates the intake valves to open the intake ports during the intake stroke, while the exhaust camshaft 112 actuates the exhaust valves to open the exhaust ports during the exhaust stroke.

Generally, at the beginning of the intake stroke, air preferably is drawn through the air intake passages 84 and fuel preferably is injected into the intake passage 84 by the fuel injectors 124. The air and the fuel thus are mixed to form the air/fuel charge in the combustion chambers. Just before or during the power stroke, the respective spark plugs ignite the compressed air/fuel charge in the respective combustion chambers. The engine 54 thus continuously repeats the foregoing four strokes during its operation.

As discussed above, during engine operation, heat builds in the engine body 82, i.e., the cylinder block 72, the cylinder head assembly 74, the exhaust manifold 106 and various peripheral engine components disposed around the engine body 82. The cooling system 31 thus is provided to help cool such engine portions and engine components.

With regard to the engine body 82, one or more water jackets preferably are provided that extend through or alongside portions of the engine body so that circulating cooling water can remove at least some of the heat accumulating in the engine portions. In the illustrated open loop cooling system, the cooling water is drawn into the cooling system 31 through a water inlet 143 from the body of water surrounding the outboard motor 30 by a water pump 144. The water inlet 143 is disposed in a portion of the lower unit 52 that preferably is positioned under the water line at a level that will generally remain submerged when the drive unit 32 is fully or almost fully tilted down. The water pump 144, in turn, is disposed in the driveshaft housing 50.

The water is pressurized toward the water jackets provided to the engine body 82 through a water supply conduit 146 and then travels through the respective water jacket or water jackets. The water that has cooled the engine portions then goes through a discharge conduit 148 (see FIG. 2) before being discharged through one or more internal portions of the driveshaft housing 50. A thermostat 150 preferably is placed along a portion of the cooling system and, more preferably, is placed at the most upstream end of the discharge conduit 148. In this location, the thermostat 150 advantageously reduces or stops a cooling water flow that passes through the discharge conduit 148 until the engine body 54 is warmed up to a preset temperature. Such an arrangement advantageously increases engine warm-up even under cold conditions.

The engine 54 also comprises a closed-loop type lubrication system. The lubrication system comprises a lubricant oil reservoir 154 preferably positioned within the driveshaft housing 50. An oil pump 156 is provided at a desired location, such as atop the driveshaft housing 50, to pressurize the oil in the reservoir 154 and to pass the oil toward engine portions, which are desirably lubricated, through lubricant delivery passages. The engine portions that should be lubricated include, for instance, the crankshaft bearings, the connecting rods and the pistons. Lubricant return passages also are provided to return the oil to the oil reservoir 154 for re-circulation. Preferably, the lubrication system further comprises a filter assembly 182 that is mounted on a starboard side surface of the cylinder block 72 to remove foreign matter from the oil (e.g., metal shavings, dirt, dust and water) before the oil is recirculated or delivered to the various engine portions.

A flywheel assembly 160 preferably is positioned above the engine body 82. The illustrated flywheel assembly 160 comprises a flywheel magneto or AC generator 162 that supplies electric power to various electrical components, comprising the fuel injection system, the ignition system and the ECU. The flywheel magneto 162 generally comprises a rotor 164 and a stator 166 and can be constructed in any suitable manner.

In the illustrated arrangement, the rotor 164 is positioned atop the crankshaft 80 and is mounted for rotation with the crankshaft 80. Preferably, the rotor 164 is configured as an overturned cup shape and is made of cast iron or another suitable material such that it has a relatively large mass. The large mass is desired, eventhough it is positioned at the top end of the outboard motor, because the rotor 164 concurrently acts as a flywheel to smooth rotation of the engine. A plurality of magnets 168 is affixed to the inner side surface of the rotor 164. The magnets 168 are juxtaposed with each other but are spaced apart from one another to form gaps between the magnets 168.

The stator 166 is affixed to a ring-shaped bracket 172 that is mounted on the engine body 82. The stator 166 comprises a plurality of electrical coils 174 facing the magnets 168 on the rotor 164. When the rotor 164 rotates around the stator 166, the magnets 168 intermittently pass the electrical coils 174. Electric power is induced in the coils to generate electric power (i.e., AC power) by a well-known electromagnetic induction effect. The generated AC power preferably is rectified and is regulated by a rectifier-regulator and then is accumulated in a battery so that the electrical components comprising the fuel injection system, ignition system and ECU can use DC power. The battery is preferably placed in the hull of the watercraft 38.

The flywheel assembly 160 also comprises a ring gear 178 that extends around an outer surface of the illustrated flywheel assembly 160. A starter motor (not shown) preferably drives the crankshaft 80 to start the engine 54. The starter motor has a gear portion that meshes with the ring gear 178. To start the engine 54, the starter motor drives the crankshaft 80 through the gear connection. Once the engine 54 starts, the starter motor immediately preferably is disengaged to reduce the likelihood that the starter mechanism will be damaged.

A protective cover 180 is detachably mounted atop the engine body 82 to extend over at least a portion of the flywheel assembly 160 and the camshaft drive mechanism. The protective cover 180 is useful to protect the flywheel assembly 160 and the drive mechanism which include the moving parts described above when the top cowling 60 is detached.

Figure 2:
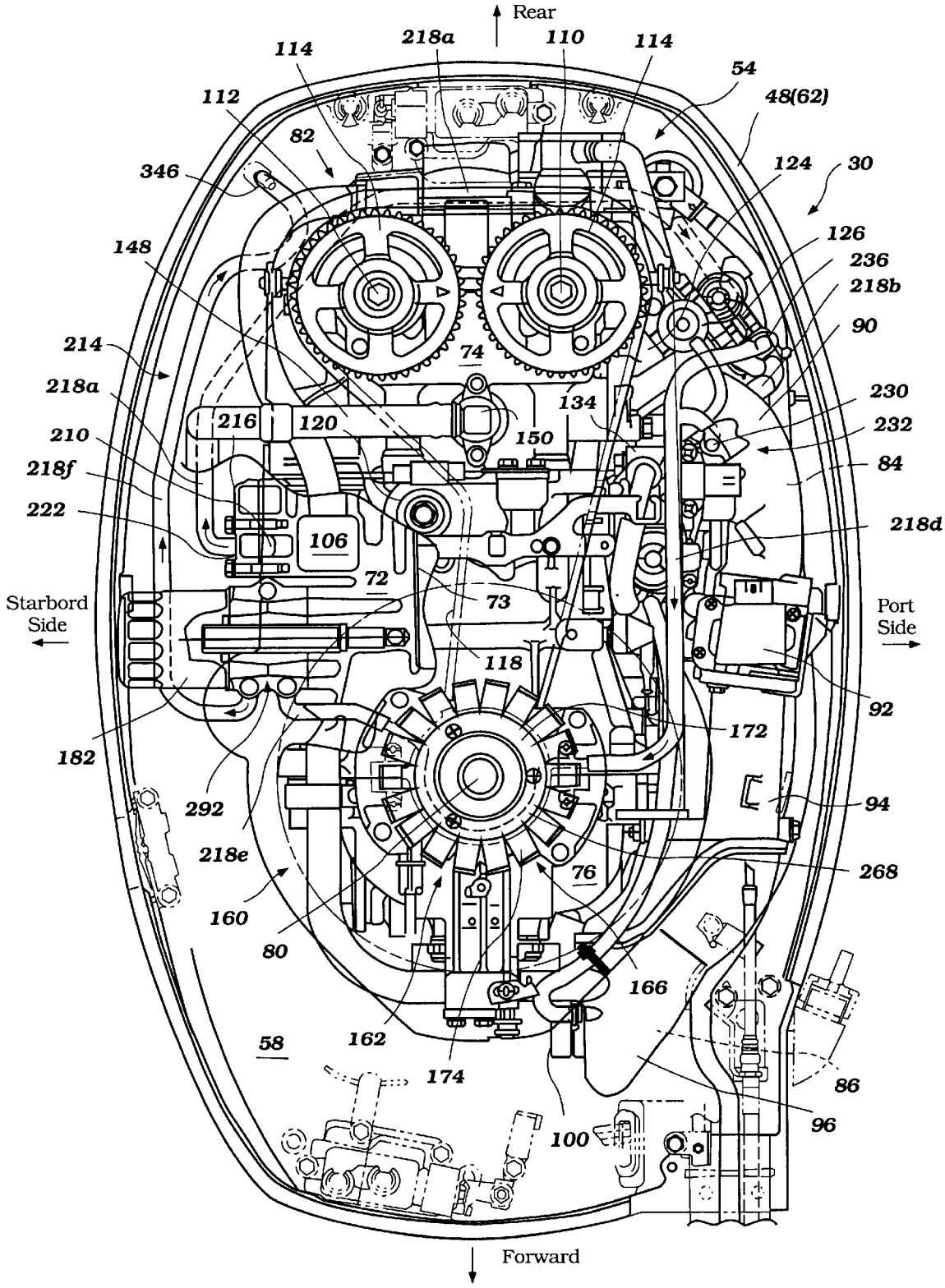
FIG. 2 is a top plan view showing a power head of the outboard motor. A top cowling member is detached. A portion of the engine is shown in section.

As seen in FIG. 1, the driveshaft housing 50 depends from the power head 48 and supports a driveshaft 184 which is driven by the crankshaft 80. The driveshaft 184 extends generally vertically through the driveshaft housing 50. The driveshaft 184 preferably drives the water pump 144 and the oil pump 156. The driveshaft housing 50 also defines internal passages which form portions of the exhaust system. An apron 185 covers an upper portion of the driveshaft housing 50 and improves the overall appearance of the outboard motor.

The lower unit 52 depends from the driveshaft housing 50 and supports a propulsion shaft 186, which is driven by the driveshaft 184. The propulsion shaft 186 extends generally horizontally through the lower unit 52. A propulsion device is attached to the propulsion shaft 186 and is powered through the propulsion shaft 186. In the illustrated arrangement, the propulsion device is a propeller 188 that is affixed to an outer end of the propulsion shaft 186. The propulsion device, however, can take the form of a dual counterrotating system, a hydrodynamic jet, or any of a number of other suitable propulsion devices.

A transmission 192 preferably is provided between the driveshaft 184 and the propulsion shaft 186. The transmission 192 couples together the two shafts 184, 186 which lie generally normal to each other (i.e., at a 90° shaft angle) with bevel gears. The outboard motor 30 has a switchover or clutch mechanism that allows the transmission 192 to change the rotational direction of the propeller 180 among forward, neutral or reverse.

The lower unit 52 also defines an internal passage that forms a discharge section of the exhaust system. At engine speeds above idle, the exhaust gases generally are discharged to the body of water surrounding the outboard motor 30 through the internal passage and finally through an outlet passage defined through the hub of the propeller 180. Of course, an above-the-water discharge can be provided for lower speed engine operation. The difference in the locations of the discharges accounts for the differences in pressure at locations above the waterline and below the waterline. Because the opening above the line is smaller, pressure develops within the lower unit 52. When the pressure exceeds the higher pressure found below the waterline, the exhaust gases exit through the hub of the propeller. If the pressure remains below the pressure found below the waterline, the exhaust gases exit through the smaller opening above the waterline.

The water that is discharged into the driveshaft housing 50 after cooling the engine preferably is used to cool the internal passages of the driveshaft housing 50 and the lower unit 52. In one configuration, the water is collected in a portion of the lower unit 52 and then is discharged to the body of water through a discharge port (not shown) or through the hub of the propeller 180 along with the exhaust gases.

With continued reference to FIGS. 1–4 and with additionally reference to FIGS. 5–14, the cooling system 31 will now be described in greater detail below. As described above, the cooling system 31 generally comprises the water inlet 143 through which cooling water is introduced into the water supply conduit 146, the water pump 144 pressurizing the water to the supply conduit 146, a set of one or more water jackets extending alongside or through the engine body 82 and the discharge conduit 148 discharging the water after it has passed through the water jackets. In the illustrated arrangement, the cooling system 31 comprises another route through which the water is provided for cooling the peripheral engine components.

As used through this description, the term "peripheral engine components" or simply "engine component(s)" means all systems, apparatus, devices, accessories, conduits, components, members, elements and other things that are disposed externally around the engine body in connection with engine operations. The definition will be clearer in the context of the following descriptions regarding exemplary configurations.

As schematically shown in FIG. 1, the water supply conduit 146 branches off in two directions at a water pool 210 disposed within the engine body 82. A first branch passage 212 is directed to the water jackets of the engine body 82, while a second branch passage 214 is directed to the engine components. As best seen in FIGS. 2 and 4, the water pool 210 preferably is disposed next to the exhaust manifold 106 at a lower portion of the cylinder block 72 on the starboard side. In the illustrated arrangement, the water pool 210 is formed within a recess defined at an outer surface of the cylinder block 72 and another recess defined at an inner surface of a cover member 216 which is affixed to the outer surface of the cylinder block 72. Of course, other configurations also are possible. The first branch passage 212 desirably is one of the water jackets formed through the cylinder block 72 while the second branch passage 214 preferably comprises several external conduits 218*a*, 218*b*, 218*c*, 218*d*, 218*e*, 218*f* and a number of internal conduits defined within the respective engine components.

As best seen in FIG. 2, in the illustrated arrangement, the external conduit 218*a* is coupled with the water pool 210 at an outlet port 222 thereof and then extends generally along a lower profile of the cylinder head assembly 74, i.e., extends rearwardly, transversely and then forwardly to the port side of the engine body 82. As seen in FIG. 3, the illustrated conduit 218*a* then bifurcates at the lowermost portion of the cylinder head assembly 74 on the port side to form the external conduit 218*b* and the conduit 218*c*.

The external conduit 218*b* then goes up toward the intake manifolds 90, which define a first group of the engine components that need cooling. Advantageously, cooling the intake manifolds can increase engine efficiency. The external conduit 218*b* is coupled with a passage portion 224 defined in a body of the lowermost manifold 90 and extending generally vertically therethrough. The other manifolds 90 also have similar passage portions 224. Conduit portion 226, which has through-holes, couples with the respective passage portions 224. Preferably, the conduit portions 226 are unitarily formed with the manifolds 90 during casting of the manifolds 90.

Both the passage portions 224 and the conduit portions 226 thus are basically made of an unlined aluminum based alloy as well as the manifolds 90 themselves. However, it is anticipated that the illustrated outboard motor 30 is often used on the ocean and seawater, i.e., salt water, therefore will frequently flow through the passage portions 224 and the conduit portions 226. Because salt water can corrode the aluminum alloy, an inner pipe member or tubular member made of brass preferably is embedded in the mold at desired locations before the manifolds are cast to form an protective internal water passage 230 that extends along at least a portion of, and preferably the entire, length of the passage portions 224 and the conduit portions 226. This construction of the passage portions 224 and the conduit portions 226, lined or unlined, forms a heat exchange construction or arrangement 232 that is formed in connection with the intake manifolds 90.

In this beat exchange construction 232, the water coming from the water pool 210 flows upwardly through the internal water passage 230 to remove at least some of the heat accumulating in the intake manifolds 90. This heat exchange construction 232 is advantageous because the air cooled by this construction 232 increases the charging efficiency. In other words, higher temperature are is less dense than lower temperature air. Accordingly, the decreasing the temperature of the intake air, more air can be drawn into the combustion chambers to provide a better air to fuel ratio for more complete combustion or to provide more air, which can be mixed with more fuel to increase the power generated during combustion.

Figure 5:
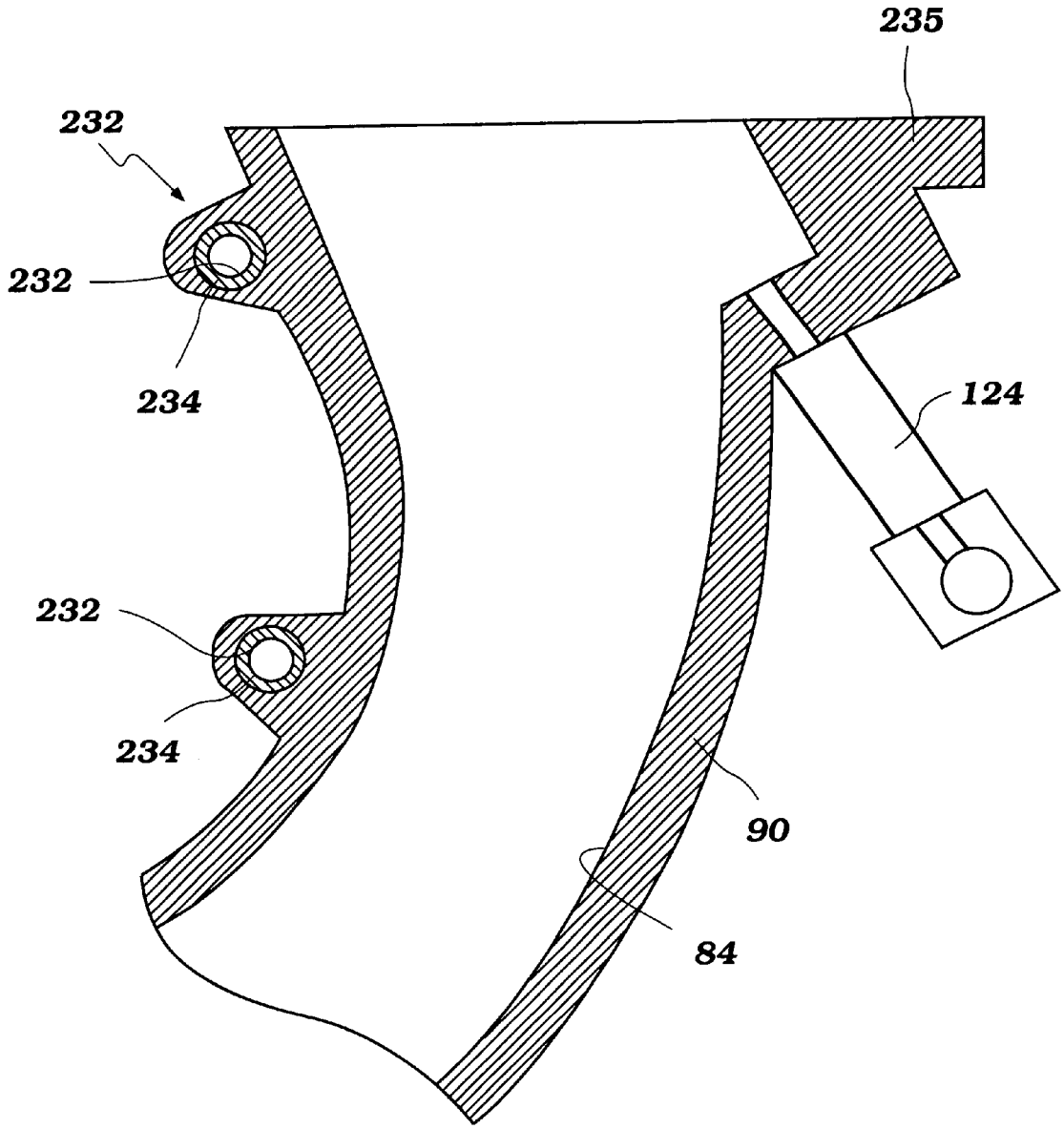
FIG. 5 is a cross-sectional view of an exemplary air intake conduit provided with water passages.

FIG. 5 illustrates another exemplary heat exchange construction for the intake manifolds 90. In this arrangement, each intake manifold 90 comprises the intake passage 84 through which air passes. Each manifold 90 also has a flange portion 235 at which the manifold 90 is affixed to the cylinder head assembly 74. In the illustrated construction, the intake manifolds 90 have a pair of internal water passages 230. The external conduit 218*b* branches off toward the respective water passages 230 under the lowermost manifold 90 and then merges together above the uppermost manifold 90. A pair of inner pipe members 232 is embedded is a manner similar to that described above. It should be noted that the number of pipe members can vary and three or more internal water passages are, of course, practicable.

Figure 6:
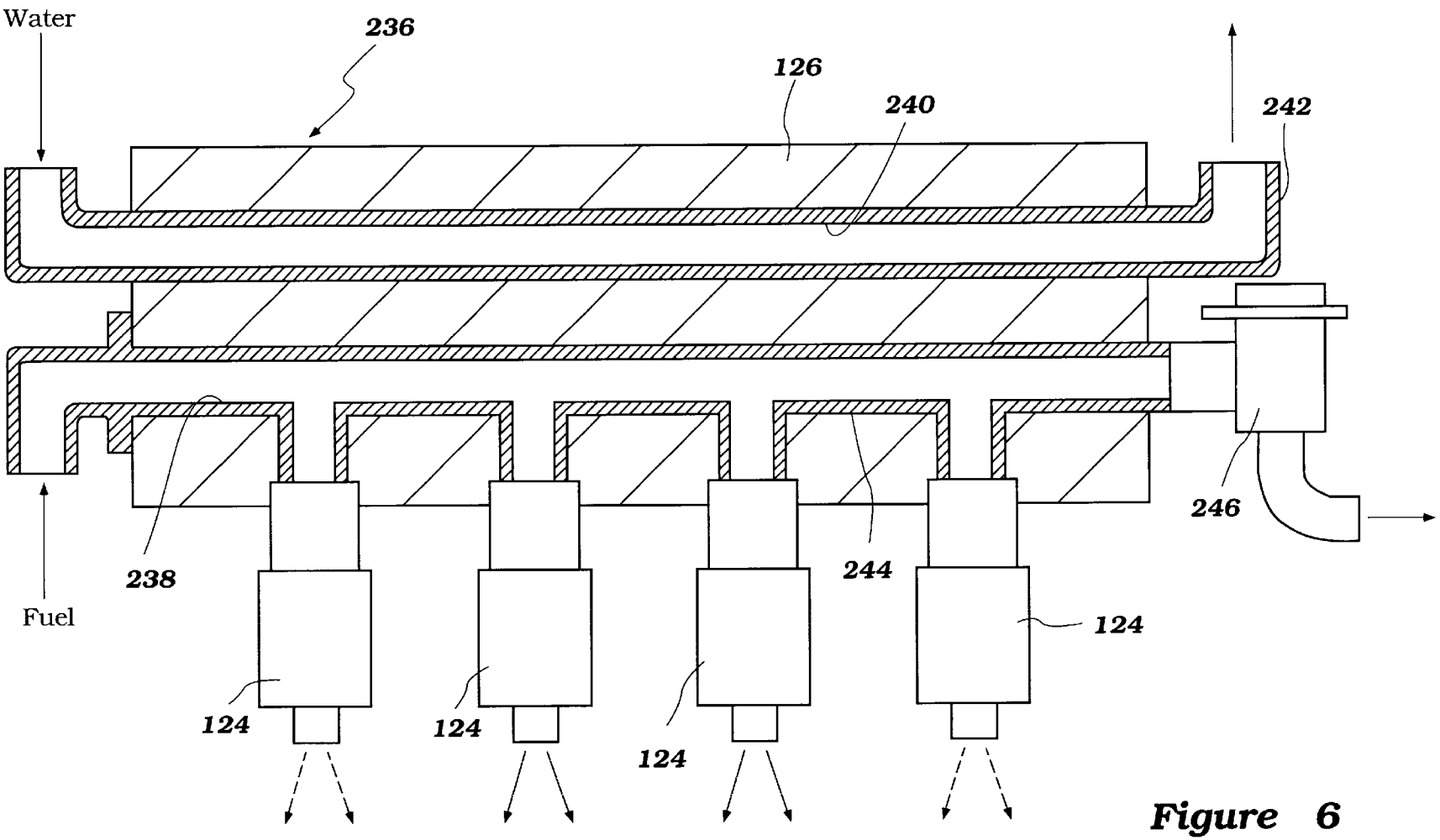
FIG. 6 is a schematic view of a heat exchanger and fuel rail construction.

In another arrangement, the fuel rail 126 is another engine component that can be cooled. Cooling the fuel rail is advantageous because, except under very cold conditions, the fuel passing through the fuel rail 126 generally should not be heated or warmed by engine heat. Such heating can cause the fuel to vaporize or can otherwise decrease the density of the fuel. Thus, in the illustrated arrangement, the other external conduit 218*c* extends upward and is coupled to the fuel rail 126, as best seen in FIG. 6. The fuel rail 126 preferably has a heat exchange construction or arrangement 236 in which an internal fuel passage 238 and an internal water passage 240 extend generally parallel to each other. The fuel passage 238 has four branches connected to the respective fuel injectors 124 that are supported by the fuel rail 126. The external conduit 218*c* is coupled with the bottom end of the internal water passage 240. In some arrangements, the fuel rail 126 could be completely or substantially completely jacketed.

Because the fuel rail 126 is formed with aluminum based alloy as noted above, an inner pipe member 242 made of brass preferably is embedded in the fuel rail body in a casting process of the fuel rail 126 to define a protected internal water passage 240. In the illustrated arrangement, the fuel passage 238 also is defined by an inner pipe member 244 which is made of brass and embedded in the same manner. It should be noted that the inner pipe member 244 can be made of other metal material than the brass because no seawater passes therethrough. However, to reduce differential thermal expansion concerns, it is currently preferred that the two pipe members 242, 244 be formed of similar materials.

This heat exchange construction 236 is advantageous because possible vapor lock and/or deposit that may be formed at the nozzle portions of the fuel injectors 124 can be obviated. In addition, the accuracy of the fuel injection amount can be improved by cooling the fuel to a preset temperature range and maintaining the fuel temperature in this general range. It is anticipated that heat exchange constructions also can be disposed along the fuel supply system at other locations, i.e., components other than the fuel rail 126 such as a fuel supply conduit and/or a delivery conduit.

Figure 7:
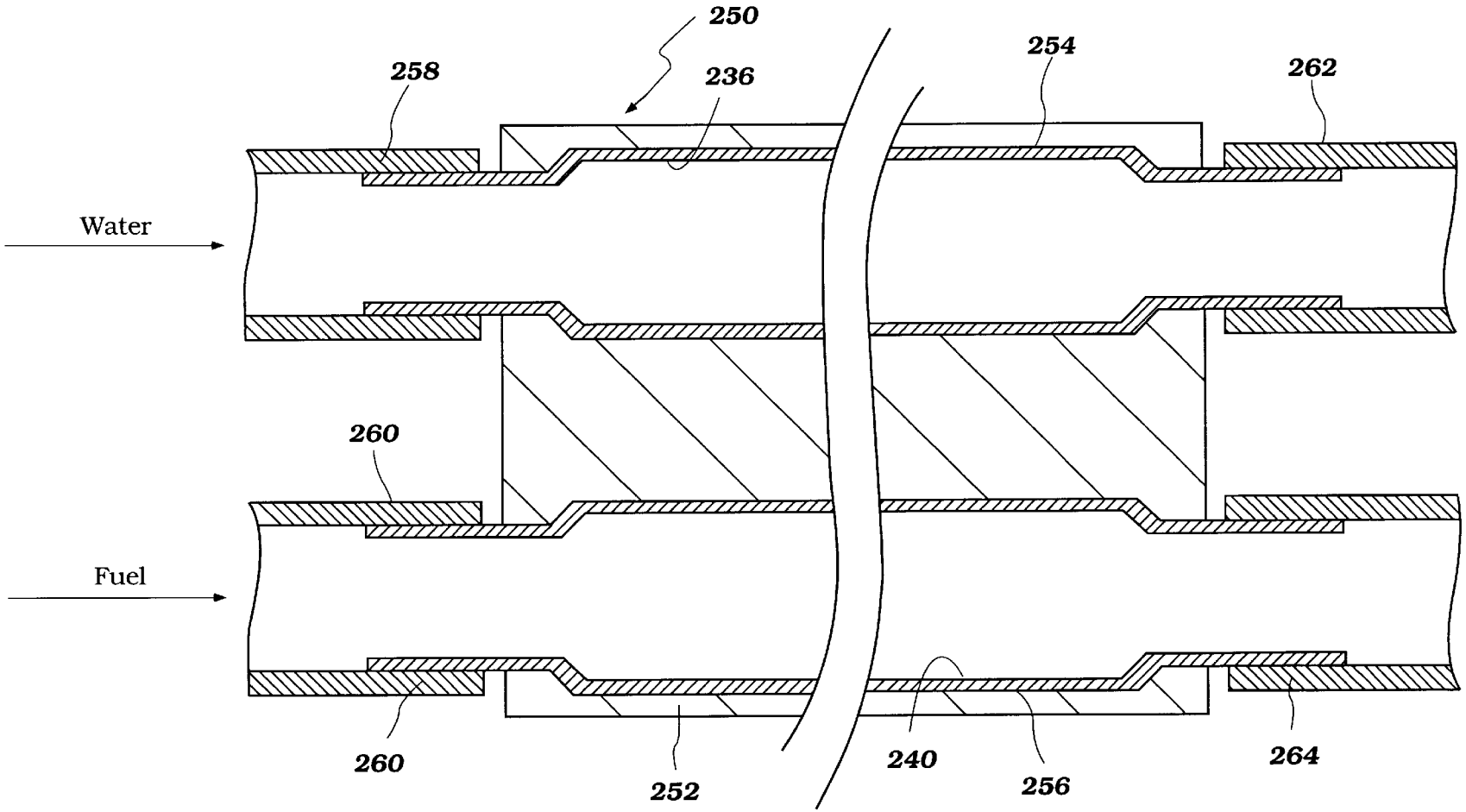
FIG. 7 is a schematic view of a heat exchanger and fuel conduit assembly construction.
Figure 8:
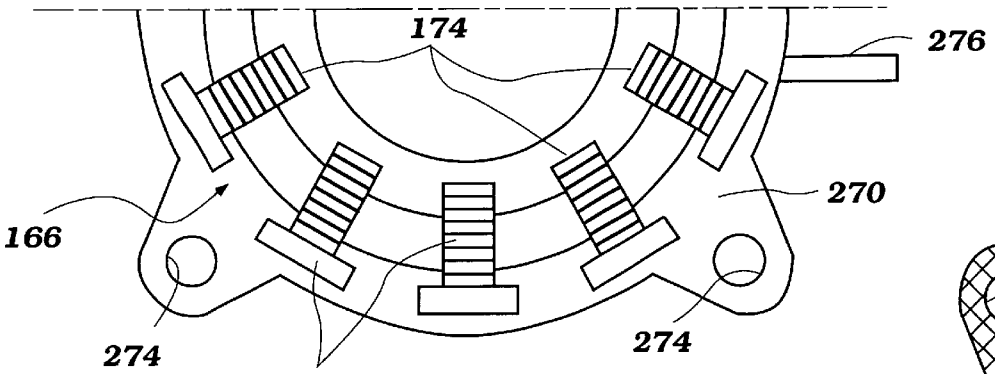
FIG. 8 is a schematic top plan view showing a stator of a flywheel magnet. For clarity, a portion of the stator is omitted in this figure.
Figure 9:
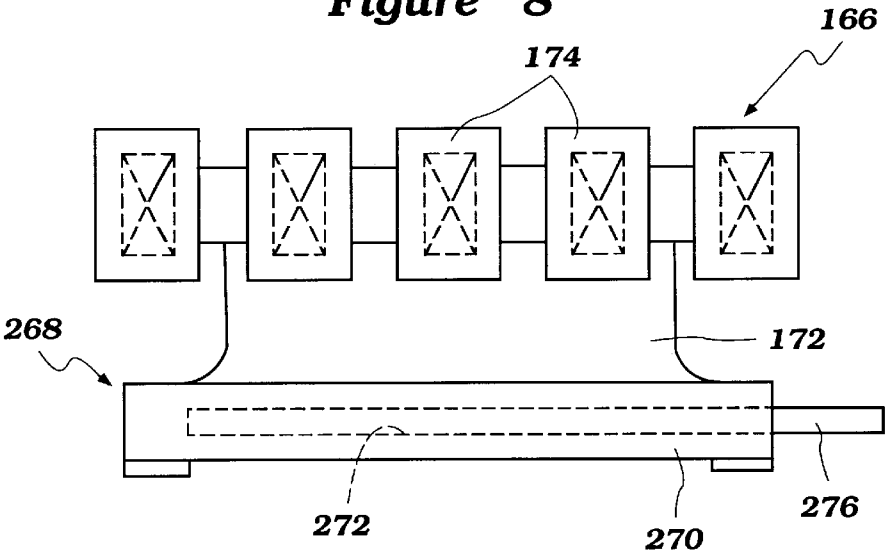
FIG. 9 is a schematic side view of the stator of FIG. 8.
Figure 10:
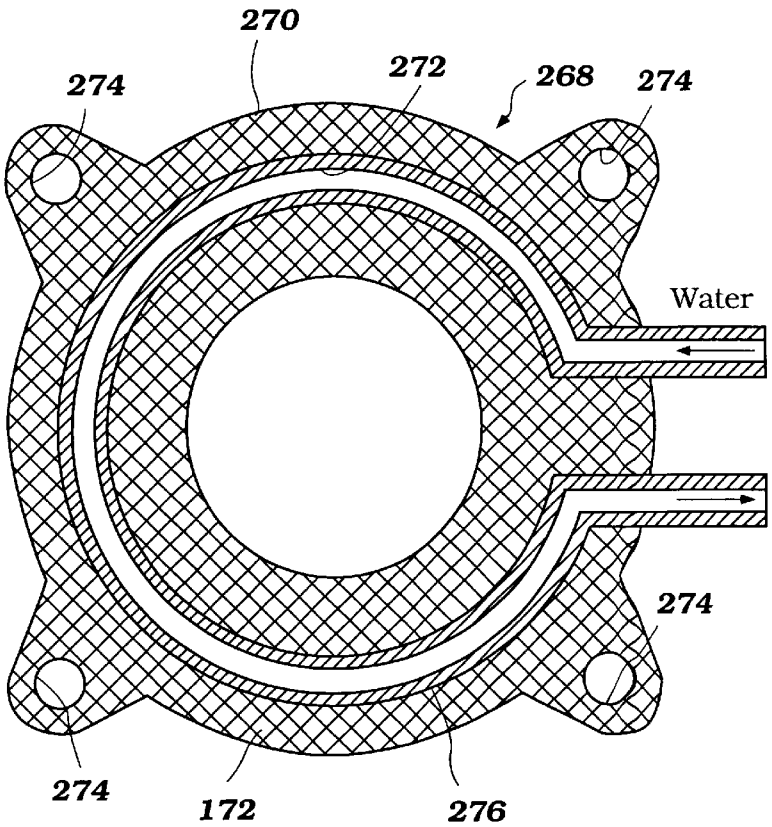
FIG. 10 is a schematic cross-sectional view of a heat exchanger and stator bracket construction.

With reference now to FIG. 7, another engine component that can have a exchange construction 250 is illustrated. In this arrangement, a cast block 252 made of aluminum based alloy replaces the fuel rail 126. Inner pipe members 254, 256 are embedded in the block 252 and extend generally parallel to each another to form the water passage 236 and the fuel passage 240. Each pipe member 254, 256 preferably has a main portion and inlet and outlet portions. A diameter of the main portion desirably is greater than each diameter of the inlet and outlet portions. The inlet and outlet portions extend beyond both ends of the block 252. Outer pipes 258, 260, 262, 264, which are preferably made of elastic material such as, for example, plastic or rubber, are fitted to the respective ends of the inlet and outlet portions so as to form each part of the cooling water conduit and the fuel supply or delivery conduit. This arrangement also is effective in controlling the temperature of the fuel supply.

With reference again to FIG. 3, the external conduits 218*b*, 218*c* merge together above the uppermost intake manifold 90 to form a single external conduit 218*d*. The external conduit 218*d* then extends forwardly along a top end of the cylinder block 72 toward the stator 166 of the flywheel magneto 162 defined in the flywheel assembly 160. The stator 166 is a third engine component that can be cooled. The electrical coils 174 build heat that can be removed through a suitable heat exchange construction. Because the stator 166 is compactly arranged, a heat exchange construction 268 for the stator 166 preferably is provided at the ring-shaped bracket 172.

As noted above and best seen in FIGS. 8–10, the stator 166 preferably is affixed to the ring-shaped bracket 172 by bolts or other fasteners and the electrical coils 174 are placed radially and side by side around the stator 166. The stator 166 and the ring-shaped bracket 172 desirably are made of metal such as, for example, aluminum based alloy. The heat produced by the coils 174 thus is conducted to the ring-shaped bracket 172 through the stator body. The ring-shaped bracket 172 has a flange 270 projecting from a bottom periphery of the bracket 172. The ring-shaped bracket 172 preferably is affixed to a top surface of the cylinder block 72 at this flange 270 by bolts or other fasteners. Four bolt or fastener holes 274 are provided in this arrangement, but other fastening arrangements also can be used.

A pipe member 276, preferably made of brass, desirably is embedded within the bracket 172 in a casting process of the bracket 172 to define an internal water passage 272 extending circularly along the outer periphery of the flange 270 and under the coils 174. Both ends of the pipe member 274 extend outwardly beyond an end surface of the bracket 172 and the foregoing external conduit 218*d* is coupled to one of the ends of the pipe member 274 placed on the port side as best seen in FIG. 2. Of course, the pipe member 274 can be attached to the cooling system in other manners, such as internally extending fittings and the like. An inlet port of the pipe member 274 is defined at the end coupled to the external conduit 218*d*. The other end of the pipe member 274, which defines an outlet port, is placed on the starboard side as seen FIG. 2. Of course, other configurations also can be used.

The cooling water which enters the internal water passage 272 through the inlet port from the external conduit 218*d* passes all the way through the passage 272 and then goes to the outlet port. During this movement, the water absorbs some of the heat accumulated in the bracket 172 that has been conducted from the coils 174 through the stator 166. In this arrangement, because the heat exchange construction 268 is formed with such a simple water passage 272 defined in the ring-shaped bracket 172, the cooling water advantageously continues flow and generally will not stagnate along any portion of the passage 272, In other words, the rapid movement of the cooling water helps reduce the heat build up that may occur within the stator bracket 182. Similar to the engine components described above, the water, even if it is seawater, advantageously does not easily corrode the ring-shaped bracket 172 because the pipe member 276 is formed of brass and the pipe member 276 covers the internal water passage 272 so as to protect the bracket body from the seawater.

Figure 11:
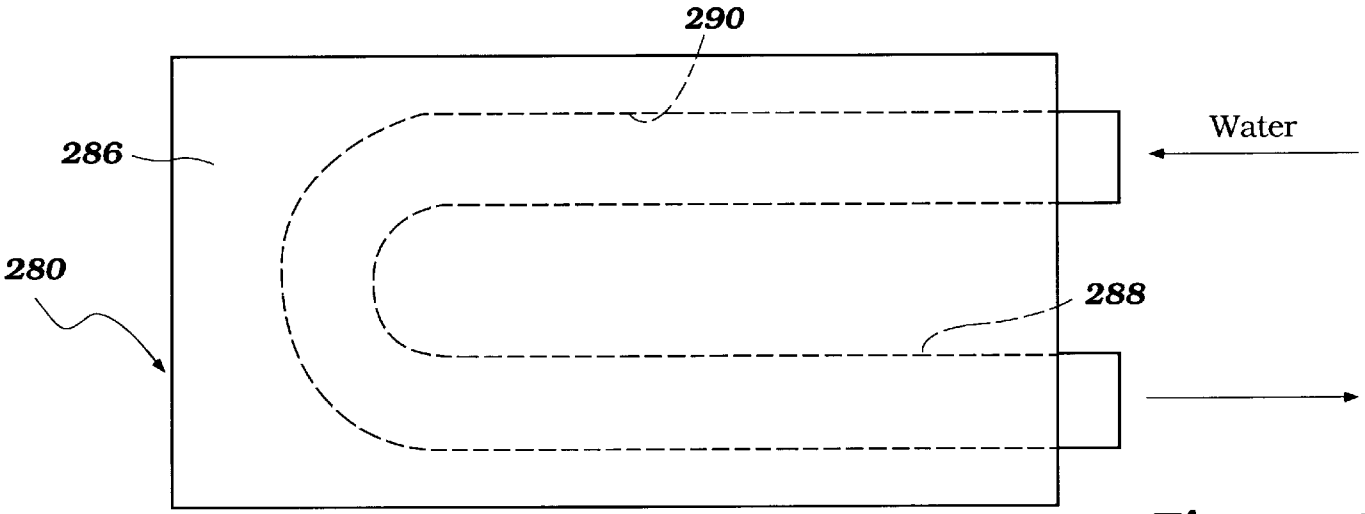
FIG. 11 is a top plan view showing a rectifier-regulator assembly with a heat exchange construction.
Figure 12:
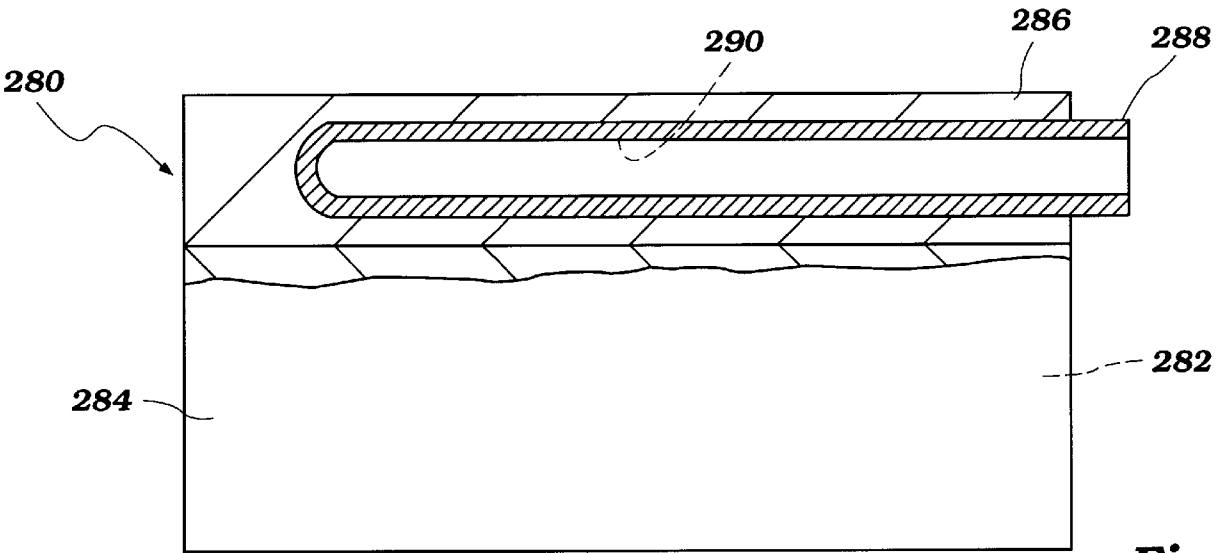
FIG. 12 is a side view of the heat exchange construction for a rectifier-regulator assembly.

With reference now to FIGS. 11 and 12, a further engine component that has another heat exchange construction 280 is illustrated therein. The component in this alternative is a rectifier-regulator 282. The rectifier-regulator 282 rectifies the AC power which is generated by the flywheel magneto 162 to DC power and also regulates the power under a preset voltage. The rectification and regulation is accompanied with production of heat and thus should be cooled in an appropriate manner.

The rectifier-regulator 282 typically is confined within a metallic container 284 and spaces remaining around electric circuit elements are preferably filled with resin or plastic material. A heat exchange block 286 made of aluminum based alloy is preferably attached to a surface of the container 284. In the illustrated arrangement, a U-configured pipe member 288 which is made of brass is embedded within the block 286, preferably when the block is form in a casting process, to define an internal water passage 290. Like the inlet and outlet ports of the ring-shaped bracket 172, one of the external conduits extending around the engine body 82 can be coupled to these ports to let the cooling water flow through the water passage 290. The brass pipe member 288 also protects the block 286 from the corrosion of the seawater. A bolt or other fastener connection, such as adhesives, can be used to couple the block 286 with the container 284 of the rectifier-regulator 282.

With reference again to the stator 166 and the ring-shaped bracket 172, the external conduit 218*e* is connected to the outlet port of the bracket 172, which is formed with the end portion of the pipe member 276. As best seen in FIG. 4, the external conduit 218*e* then extends downwardly along a side surface of the cylinder block on the starboard side to the oil filter assembly 182. The filter assembly 182 is yet another engine component that can be cooled by the cooling system 31. This is because, if the oil accumulates heat, its viscosity decreases and hence lubrication performance can deteriorate. Another heat exchange construction 292 thus is provided for the oil filter assembly 182.

Figure 13:
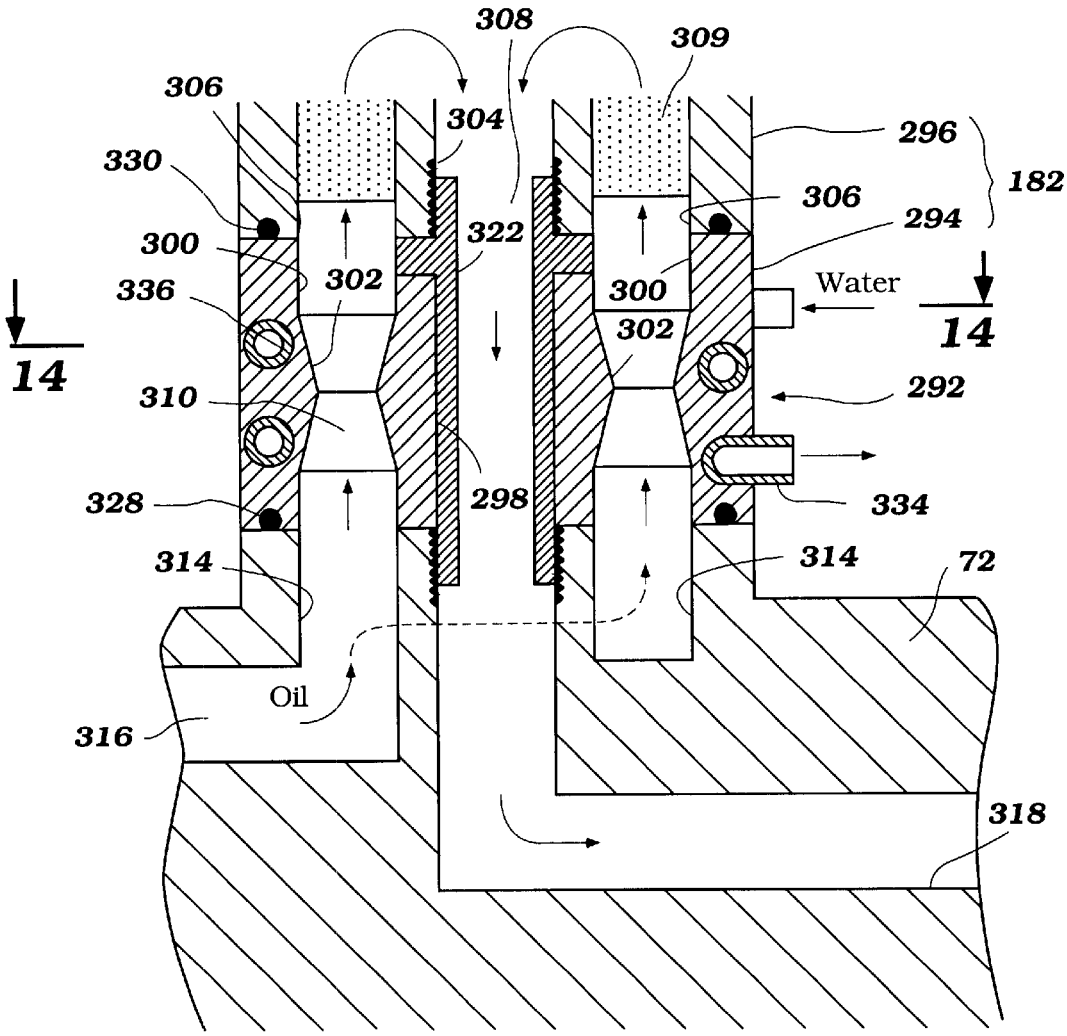
FIG. 13 is a cross-sectional view of an oil filter assembly with a heat exchange construction generally taken along the line 13—13 of FIG. 4.

With reference to FIG. 13, the filter assembly 182 comprises a base member 294 and a filter member 296. The base member 294 preferably is made of a cast aluminum-based alloy like the foregoing engine components. The base member 294 thus defines a downstream portion 298 that is disposed generally on the center axis of the base member 294 and a plurality of upstream portions 300 disposed around the downstream portion 298. The respective portions 298, 300 preferably extend generally horizontally. Each upstream portion 300 advantageously is configured to have a tapered or narrow part 302, which increases the flow rate in that region.

The filter member 296 also defines a downstream portion 304 that communicates with the downstream portion 298 of the base member 294 and a plurality of upstream portions 306 that communicate with the upstream portions 306. The respective portions 304, 306 preferably also extend generally horizontally. The downstream portions 298, 304 together define a downstream oil passage 308 while the upstream portions 302, 306 together define an upstream oil passages 310. The downstream and upstream oil passages 308, 310 communicate with one another. A single filter element 309 can be disposed in the communicating portion. That is, both the passages 308, 310 are coupled with each other through the filter element 309.

The upstream oil passages 300 communicate with oil supply galleries 314 defined within the cylinder block 72 and merge with each other further upstream to form a single oil supply gallery 316. The downstream oil passage 308 is connected to a delivery oil gallery 318 defined also within the cylinder block 72. The oil supply gallery 316 thus communicates with the oil delivery gallery 318 through the upstream and downstream oil passages 310, 308 via the oil filter element 309.

A coupling member 322 couples the cylinder block 72, the base member 294 and the filter member 296 together. The illustrated coupling member 322 is generally cylindrically configured and has a flange 324. Both outer ends of the illustrated coupling member 322 are threaded. Because the end of the delivery gallery 318 where the downstream passage 308 is connected and the end of the downstream portion 304 of the filter member 296 are also threaded, and in addition, an outer diameter of the coupling member 322 generally equal to an inner diameter of the downstream oil passage 308, the coupling member 322 connects itself to both the cylinder block 72 and to the filter member 296. Of course, other methods of coupling also can be used. However, the illustrated arrangement is advantageously simple and secure.

In a preferred arrangement, the coupling member 322 is first coupled to the cylinder block 72 by connecting the base member 294 with the flange 324 and then the filter member 296 is coupled to the coupling member 322. Because of this coupling construction, the filter assembly 182 is detachable as a unit from the cylinder block 72. Of course, in some configurations, the filter member 296 can be formed for removal separate from the filter assembly 182. In order to inhibit oil flowing through the passages from leaking out, an O-ring or seal member 328 is preferably inserted between the cylinder block 72 and the base member 294, and another O-ring or seal member 328 is also preferably inserted between the base member 294 and the filter member 296.

Oil is thus provided to the engine portions that need lubrication through the supply gallery 316, the upstream passage 310, the filter element 309, the downstream passage 30 and the delivery gallery 318. As noted above, heat accumulated in the oil is removed at the filter assembly 182 in this embodiment. Thus, the illustrated filter assembly arrangement can improve the life of the lubricant used in the illustrated engine and can improve performance of the lubrication system.

An inner pipe member 334, which advantageously can be made of brass, preferably is embedded within the base member 294 in a casting process thereof to define an internal water passage 336. The pipe member 334 in this construction preferably is configured spirally around the upstream portions 300 of the oil passages 310. Both ends of the pipe member 334 extend outwardly beyond an end surface of the base member 334 and the foregoing external conduit 218*e* is coupled to one of the ends of the pipe member 334 placed next to a side surface of the cylinder block 72. Of course, other coupling arrangements also can be used. In the illustrated arrangement, however, one end is thus an inlet port of the pipe member 334. The other end of the pipe member 334, which defines an outlet port, is placed outside of the inlet port relative to the cylinder block 72.

Cooling water comes in through the inlet port and flows all the way through the internal water passage 336 defined by the spiral pipe member 334. While traversing the passage 336, the water removes some of the heat accumulating in the base member 294 and also in the oil passing through the upstream portions 300 of the upstream oil passages. This is advantageous because the viscosity of the oil can be held under an appropriate condition. Like the foregoing engine components, the water, even if it is seawater, does not substantially corrode the base member 294 because the brass pipe member 334 protects the base member 294 from the seawater.

Figure 14:
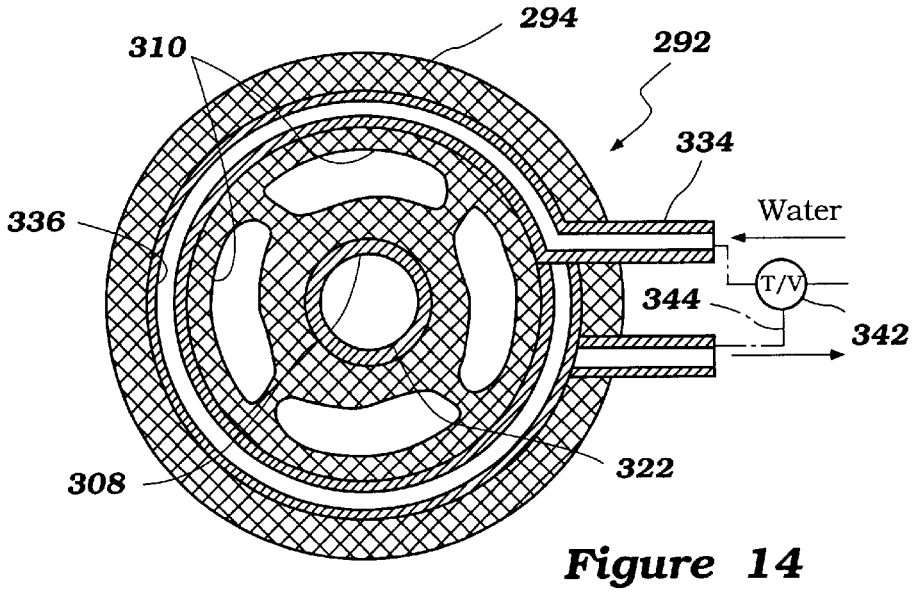
FIG. 14 is a cross-sectional view of the oil filter assembly taken along the line 14—14 of FIG. 13.

If the base member 294 does not accumulate heat immediately after the engine 54 has started up, the cooling water is preferably inhibited from flowing therethrough because oil should be warmed up rather than cooled down. FIG. 14 illustrates in phantom an additional arrangement that allows the oil to be suitably heated prior to cooling and maintaining a desired temperature range. Specifically, a three-direction thermo-valve 342 is preferably provided upstream the inlet port with a bypass water passage 344 branching off from the valve 342 and being directly connected to the outlet port in this arrangement. If the temperature of the water is lower than a preset temperature, the valve 342 allows the water to flow through the bypass passage 344 such that the internal water passage 336 is bypassed. If the temperature has reached a preset temperature, the valve allows the water to flow the internal water passage 336 and the temperature of the oil can be controlled.

As best seen in FIGS. 2 and 4, the external conduit 218*f* preferably is connected to the outlet port of the pipe member 334 and desirably extends generally along a lower profile of the cylinder head assembly 74 together with, and generally parallel to, the external conduit 218*a*. The bottom cowling member 62 preferably has a pilot discharge port 346 at a comer on the rear starboard side. A nipple preferably extends toward the internal cavity 58 of the cowling assembly 56 from the discharge port 346 and the end of the external conduit 218*f* is fitted onto the nipple. The pilot discharge port 346 thus is positioned closer to the engine body 82 than to the water inlet port 143. To the contrary, the propeller hub, through which the water that has cooled the engine body 82 flows, desirably is positioned closer to the water inlet port 143 than to the engine body 82.

In the illustrated arrangement, all the water that has traveled around the engine components will be discharged through the pilot discharge port 346. The pilot discharge port can be defined in an upper area of the driveshaft housing. The water discharge thus is visible by the watercraft operator. This is advantageous because the operator can recognize that at least this portion of the cooling system 31 is functioning as expected because of the visual confirmation of the water discharge. The water passing through the engine components is not as hot as the water passing through the engine body 82 itself because the engine components themselves do not produce the same level of heat and most only absorb heat conducted from the engine body 82. Thus, this pilot discharge has a reduced temperature that is less likely to deteriorate coatings on the drive unit 32 and hence the neat appearance of the outboard motor 30 can be kept accordingly.

As described above, in the illustrated embodiment, the first water passage supplies water cooling the engine body, while the second water passage branches off from the first water passage upstream the engine body and supplies water cooling the engine components in series. One of the engine components, i.e., the stator, is positioned above the engine body and two other components, i.e., the intake manifolds (or the fuel rail) and the oil filter assembly, preferably are positioned on different sides of the engine body, i. e., on the port side and the starboard side, respectively. The cooling system thus can cool the engine body and the engine components efficiently and can hold good heat balance in connection with the respective sides.

In addition, the water is unlikely to stagnate because of the arrangement connecting the respective component in series. However, it is anticipated that the arrangement also can employ either entire or partial parallel connections. For instance, if two or more components extend in parallel or these components have generally the same heat level, then the cooling system can have connections arranged in parallel. Preferably, an engine component that can produce or accumulate heat causing an operating temperature greater than the operating temperature of another component is placed downstream of the other component. Thus, the cooler components should be cooled first. Of course, this is a mere guideline and other arrangements or layouts can be practicable if arrangements complying with the guideline are too complicated or the lengthy.

The engine components described above preferably have bodies made of aluminum-based alloy and the pipe members, which preferably are made of brass, are embedded within the bodies because the aluminum alloy has the excellent heat transfer rate and the brass has the good anti-corrosion nature. Other metal materials, however, also can be used. For example, a copper-based alloy, which has also a good heat transfer rate, can replace the aluminum-based alloy. In addition, stainless pipe members can replace the brass pipe members because stainless steel is less likely to be corroded by seawater. In fact, particular types of stainless steel can be selected based upon their projected durability.

Of course, the foregoing description is that of a several preferred construction having certain features, aspects and advantages in accordance with the present invention. In addition, not all of the above-described components must be used in a single cooling system and a cooling system can employ various components without employing other components. Thus, various changes and modifications may be made to the abovedescribed arrangements without departing from the spirit and scope of the invention, as defined by the appended claims.

What is claimed is:

1. An internal combustion engine comprising an engine body, a plurality of engine components disposed around the engine body, and a water cooling system for cooling both the engine body and the engine components, the cooling system comprising a first water passage arranged to cool the engine body, and a second water passage branching off from the first water passage upstream of the engine body and extending through the plurality of engine components in series, the first and second water passages comprising separate discharge ports that are located remotely from each other, and the discharge port of the second water passage being positioned next to the engine body.

2. The engine as set forth in claim 1, wherein the plurality of engine components are made of a metal material, the second water passage being at least partially defined by tubular members made of a corrosion-resistant material, and the respective tubular members being embedded in respective bodies of the plurality of engine components.

3. The engine as set forth in claim 1, wherein the second water passage terminates at a discharge port that extends through an outer surface of an upper portion of the outboard motor.

4. An internal combustion engine comprising an engine body, a plurality of engine components being disposed around the engine body, and a water cooling system arranged to cool both the engine body and the plurality of engine components, the cooling system comprising a first water passage arranged to cool the engine body and a second water passage branching off from the first water passage upstream of the engine body and extending through the plurality of engine components, the plurality of engine components being made of a metal material, the second water passage in part being defined by tubular members made of a corrosion-resistant material and the respective tubular members being at least partially embedded in respective bodies of the engine components.

5. The engine as set forth in claim 4, wherein the second water passage terminates at a discharge port that extends through an outer surface of an upper portion of the outboard motor.

6. An internal combustion engine comprising an engine body, a plurality of engine components disposed around the engine body, and a cooling system for cooling both the engine body and the plurality of engine components, the cooling system comprising a first coolant passage arranged to cool the engine body, and a second coolant passage branching off from the first coolant passage upstream of the engine body and extending through at least three of the plurality of engine components, the three engine components comprising a first engine component positioned at least above the engine body, and a second engine component and a third engine component each positioned on a different side of the engine body so as to be spaced apart from each other.

7. The internal combustion engine as set forth in claim 6, wherein the second coolant passage is coupled with the first, second and third engine components in a heat exchange relationship.

8. The engine as set forth in claim 6, wherein the second water passage terminates at a discharge port that extends through an outer surface of an upper portion of the outboard motor.

9. An outboard motor comprising an engine body, a plurality of engine components disposed around the engine body, and a water cooling system comprising a water inlet disposed lower than the engine body so as to introduce the water into the cooling system, a first water passage arranged to cool the engine body and a second water passage arranged to cool the plurality of engine components, the first water passage comprising a first water discharge port positioned closer to the water inlet than to the engine body and the second water passage comprising a second water discharge port positioned closer to the engine body than to the water inlet.

10. The outboard motor as set forth in claim 9 additionally comprising a protective cowling surrounding the engine body and the engine components, wherein the second water discharge port is defined at the protective cowling.

11. The outboard motor as set forth in claim 9, wherein at least two of the plurality of engine components through which the second water passage extends are disposed on opposing sides of the engine body relative to each another.

12. The internal combustion engine as set forth in claim 9, wherein the plurality of engine components are made of a metal material, the second water passage at least in part is defined by tubular members made of a corrosion-resistant material, and the respective tubular members are at least partially embedded in respective bodies of the engine components.

13. The outboard motor as set forth in claim 9, wherein the second water passage branches off from the first water passage upstream the engine body.

14. The engine as set forth in claim 9, wherein the second water passage terminates at said second water discharge port and said second water discharge port extends through an outer surface of an upper portion of the outboard motor.

15. An internal combustion engine for an outboard motor comprising an engine body, at least three engine components disposed around the engine body, and a water cooling system for cooling both the engine body and the engine components, the cooling system comprising a first water passage arranged to cool the engine body, and a second water passage branching off from the first water passage upstream of the engine body and extending through the at least three engine components, a first of the at least three engine components being generally positioned above the engine body, and a second and a third of the at least three engine components being generally positioned on a different side of the engine body relative to one another.

16. The engine as set forth in claim 15, wherein the second water passage terminates at a discharge port that extends through an outer surface of an upper portion of the outboard motor.

17. The engine as set forth in claim 15, wherein the second water passage extends through the engine components in series.

18. The engine as set forth in claim 15, wherein at least one of the second engine component and the third engine component is disposed upstream of the first engine component.

19. The engine as set forth in claim 15, wherein at least one of the second engine component and the third engine component is disposed downstream of the first engine component.

20. The engine as set forth in claim 15, wherein the first engine component is made of metal material, the second water passage in part is defined by a tubular member made of corrosion-resistant material, and the tubular member is at least partially embedded in a body of the first engine component.

21. The engine as set forth in claim 15, wherein the first engine component comprises a power generator.

22. The engine as set forth in claim 15, wherein at least one of the second engine component and the third engine component is made of metal material, the second water passage at least in part is defined by a tubular member made of corrosion-resistant material, and the tubular member is at least partially embedded in a body of the engine component.

23. The engine as set forth in claim 15, wherein both the sides of the engine body are lateral sides thereof located opposite to one another.

24. The engine as set forth in claim 15, wherein each one of the first and second water passages comprises a separate water discharge port relative to each other.

25. The engine as set forth in claim 15 additionally comprising at least one combustion chamber defined within the engine body, and an air intake system arranged to introduce air to the combustion chamber, wherein one of the second engine component and the third engine component comprises an air intake conduit, and the second coolant passage extends through a body of the air intake conduit.

26. The engine as set forth in claim 25, wherein the air intake conduit is made of a metal material, the second water passage at least in part is defined by a tubular member made of a corrosion-resistant material, and the tubular member is at least partially embedded in the body of the air intake conduit.

27. The engine as set forth in claim 15 additionally comprising at least one combustion chamber defined within the engine body, and a fuel supply system arranged to supply fuel to the combustion chamber, wherein at least one of the second engine component and the third engine component comprises a fuel delivery conduit, and the second coolant passage extends through a body of the fuel delivery conduit.

28. The engine as set forth in claim 27, wherein the fuel delivery conduit is made of a metal material, the second water passage at least in part is defined by a tubular member made of a corrosion-resistant material, and the tubular member is at least partially embedded in the body of the fuel delivery conduit.

29. The engine as set forth in claim 27, wherein the fuel delivery conduit defines a fuel passage extending therethrough, and the second water passage extends along at least a portion of the fuel passage.

30. The engine as set forth in claim 27, wherein the fuel supply system comprises a fuel injector arranged to spray the fuel toward the combustion chamber, a fuel rail arranged to support the fuel injector, and the fuel delivery conduit is defined in the fuel rail.

31. The engine as set forth in claim 15 additionally comprising a lubrication system arranged to lubricate at least one inner portion of the engine body, wherein one of the first engine component and the second engine component comprises a lubricant delivery conduit, and the second water passage extends through a body of the lubricant delivery conduit.

32. The engine as set forth in claim 31, wherein the lubricant delivery conduit is made of a metal material, the second water passage at least in part is defined by a tubular member made of a corrosion-resistant material, and the tubular member is at least partially embedded in the body of the lubricant delivery conduit.

33. The engine as set forth in claim 31, wherein the lubrication system comprises a filter assembly, and the lubricant delivery conduit is defined in the filter assembly.

* * * * *